US010184443B2

(12) United States Patent
Abe et al.

(10) Patent No.: US 10,184,443 B2
(45) Date of Patent: Jan. 22, 2019

(54) ENGINE STARTING DEVICE

(71) Applicants: Masami Abe, Tokyo (JP); Koichiro Kamei, Tokyo (JP); Kazuhiro Odahara, Tokyo (JP); Naohito Kaneda, Tokyo (JP); Daisuke Mizuno, Tokyo (JP)

(72) Inventors: Masami Abe, Tokyo (JP); Koichiro Kamei, Tokyo (JP); Kazuhiro Odahara, Tokyo (JP); Naohito Kaneda, Tokyo (JP); Daisuke Mizuno, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 826 days.

(21) Appl. No.: 14/595,829

(22) Filed: Jan. 13, 2015

(65) Prior Publication Data

US 2015/0159617 A1 Jun. 11, 2015

Related U.S. Application Data

(62) Division of application No. 13/977,858, filed as application No. PCT/JP2011/058210 on Mar. 31, 2011, now Pat. No. 9,518,550.

(51) Int. Cl.
*F02N 11/00* (2006.01)
*F02N 15/06* (2006.01)
(Continued)

(52) U.S. Cl.
CPC ..... *F02N 15/065* (2013.01); *F02N 11/00* (2013.01); *F02N 15/023* (2013.01);
(Continued)

(58) Field of Classification Search
CPC ..... F02N 2015/061
(Continued)

(56) References Cited

U.S. PATENT DOCUMENTS 4,184,378 A 1/1980 Mazzorana
4,737,654 A 4/1988 Morishita et al.
(Continued)

FOREIGN PATENT DOCUMENTS

DE 102008054979 A1 6/2010
EP 2172645 A2 4/2010
(Continued)

OTHER PUBLICATIONS

Japanese Office Action, (Notification of Reasons for Refusal) dated Oct. 8, 2013, Patent Application No. 2013-506982.
(Continued)

*Primary Examiner* — William Kelleher
*Assistant Examiner* — Gregory T Prather
(74) *Attorney, Agent, or Firm* — Sughrue Mion, PLLC; Richard C. Turner

(57) ABSTRACT

Since a pinion gear unit which rotates according to the rotation of an output rotation shaft driven by the motor unit, a pushing mechanism which moves the pinion gear unit towards an engagement location of the pinion gear and an engine starting gear, and a bracket which includes a bracket main body unit which supports the motor unit and the pushing mechanism and a nose unit which extends from the bracket main body unit to a side opposite to the motor unit and rotatably bears a tip portion of the output rotation shaft on a side opposite to the motor unit, and which is attached to an engine side are included, a first stopper unit which restricts the movement of the rotation member to the direction of the engine starting gear is provided on the output rotation shaft, a second stopper unit which restricts the
(Continued)

movement of the pinion gears to the direction of the engine starting gear by pushing and biasing of the elastic member is provided on the rotation member, and positioning the first stopper unit is positioned on a side opposite to the engine starting gear with respect to the second stopper unit, it is possible to shorten the shaft length of the rotation member and to shorten the entire length of the engine starting device.

5 Claims, 6 Drawing Sheets

(51) Int. Cl.
*F02N 15/02* (2006.01)
*F02N 11/08* (2006.01)
*F02N 15/04* (2006.01)

(52) U.S. Cl.
CPC ..... *F02N 15/063* (2013.01); *F02N 15/067* (2013.01); *F02N 11/0851* (2013.01); *F02N 15/046* (2013.01); *Y10T 74/134* (2015.01); *Y10T 74/137* (2015.01)

(58) Field of Classification Search
USPC ..... 74/6, 7 A, 7 C, 7 R
See application file for complete search history.

(56) References Cited

U.S. PATENT DOCUMENTS

| | | | | |
|---|---|---|---|---|
| 4,916,958 | A | 4/1990 | Okamoto et al. | |
| 5,012,686 | A | 5/1991 | Morishita et al. | |
| 5,018,398 | A | 5/1991 | Nakagawa | |
| 5,197,342 | A | 3/1993 | Nakagawa | |
| 5,237,882 | A | 8/1993 | Giometti | |
| 5,331,860 | A | 7/1994 | Demoule et al. | |
| 5,370,009 | A | 12/1994 | Isozumi | |
| 5,540,110 | A | 7/1996 | Zenmei et al. | |
| 5,600,184 | A | 2/1997 | Shiga et al. | |
| 8,869,640 | B2 * | 10/2014 | Abe | F02N 11/0855 74/7 A |
| 2004/0177710 | A1 | 9/2004 | Kajino et al. | |
| 2009/0151684 | A1 | 6/2009 | Gast et al. | |
| 2011/0308490 | A1 | 12/2011 | Hartmann et al. | |

FOREIGN PATENT DOCUMENTS

| | | | |
|---|---|---|---|
| JP | 03-030575 | A | 2/1991 |
| JP | 2000-274336 | A | 10/2000 |
| JP | 2002-115636 | A | 4/2002 |
| JP | 2006-161590 | A | 6/2006 |
| JP | 2009-138656 | A | 6/2009 |
| WO | 2010069645 | A1 | 6/2010 |

OTHER PUBLICATIONS

Communication dated Sep. 19, 2014 from The Korean Intellectual Patent Office in counterpart Korean Patent Application No. 10-2013-7026984.
Communication dated Nov. 3, 2015 from the European Patent Office in counterpart application No. 11862590.4.
Communication dated Feb. 23, 2015 from the United States Patent Office in counterpart U.S. Appl. No. 13/977,858.
Communication dated Jul. 23, 2018 from the Intellectual Property Office of India in counterpart application No. 7617/CHENP/2013.

* cited by examiner

ENGINE STARTING DEVICE

CROSS-REFERENCE TO RELATED APPLICATIONS

This application is a Divisional of U.S. application Ser. No. 13/977,858 filed Jul. 1, 2013, which is a § 371 National Stage Application of PCT/JP2011/058210 filed Mar. 31, 2011; the above-noted applications are incorporated herein by reference in their entirety.

TECHNICAL FIELD

The present invention relates to an engine starting device including a pinion gear unit which rotates according to rotation of an output rotation shaft driven by a motor unit, and a pushing mechanism which moves the pinion gear unit towards an engagement location of a pinion gear thereof and an engine starting gear, in which an engine is started by a rotation force of the motor unit through the pinion gear and the engine starting gear which are engaged with each other.

BACKGROUND ART

In an engine starting device of the related art, in order to mitigate the shock at the time of collision of each edge surface of the pinion and the ring gear when the pinion is engaged with an engine starting gear such as a ring gear (hereinafter, referred to as a "ring gear"), there has been known a structure in which a pinion can be moved by a spring or the like so as to decrease a force for pushing a ring gear with an inertia force at the time of engaging the pinion. Since only the pinion can be moved, an impact force at the time of collision is converted into mass of only the pinion, it is possible to decrease a collision energy, noise is reduced and the durability is improved (for example, Patent Citation 1and 2)

[Patent Citation 1] JP-A-2006-161590 (Abstract, FIG. 2 and the description thereof)

[Patent Citation 2] JP-A-2009-138656 (Abstract, FIG. 2 and the description thereof)

DISCLOSURE OF INVENTION

Technical Problem

However, in Patent Citation 1 and 2, in order to transfer a motor rotation force of the engine starting device to the engine, it is necessary to provide an elastic member such as a spring on a movement rotation member including a pinion to be engaged with a ring gear on the engine side, and thus, a three-stage configuration is used with a first stopper unit which restricts axial direction movement of the movement rotation member to a tip side of a bracket nose (there is no reference numeral in Patent Citation 1 and 2 , but a portion displayed with hatching in the vicinity of tip bearing portion of output shafts 4 and 13 in FIG. 1 of Patent Citation 1 and 2), a second stopper unit which restricts axial direction movement of the pinion biased by the elastic member to the ring gear side (reference numeral 26 in FIG. 1 of Patent Citation 1 and reference numeral 41 in FIG. 1 of Patent Citation 2), and a third stopper unit which restricts axial direction movement of the pinion to a side opposite to the second stopper unit (reference 27 in FIG. 1 of Patent Citation 1 and reference numeral 42 in FIG. 1 of Patent Citation 2). It was difficult to avoid a long shaft length from the tip of the pinion to the tip of the engine starting device, and at the same time, the entire length of the engine starting device increased, and depending on a relationship of a layout of the engine, clearance between peripheral components of the engine cannot be secured when mounting the engine starting device, and it is difficult to mount the device to the engine.

In addition, in Patent Citation 1 and 2, since a structure in which a stopper fixing groove is provided on an outer periphery of the output shafts 4 and 13 and the first stopper unit is mounted on the output shafts 4 and 13 by interposing an O-ring on the stopper fixing groove, in a case of bracket which includes a bracket nose and bears a tip portion of the output shaft in the tip portion of the bracket nose unit, if a great force is applied to the output shaft at the time of engine starting or the like, stress is concentrated on the portion of the stopper fixing groove, and there is a concern that the output shaft is curved or damaged in the worst case.

The invention is made in consideration of these circumstances and an object thereof is to shorten a shaft length of a rotation member and to shorten an entire length of an engine starting device.

Technical Solution

There is provided an engine starting device including:

a motor unit;

a pinion gear unit which rotates according to the rotation of an output rotation shaft driven by the motor unit;

a pushing mechanism which moves the pinion gear unit towards an engagement location of the pinion gear and an engine starting gear;

and a bracket which includes a bracket main body unit which supports the motor unit and the pushing mechanism and a nose unit which extends from the bracket main body unit to a side opposite to the motor unit and rotatably bears a tip portion of the output rotation shaft on a side opposite to the motor unit, and which is attached to an engine side, in which an engine is started by a rotation force of the motor unit through the pinion gear and the engine starting gear which are engaged with each other, the pinion gear unit includes a rotation member which spline-coupled to the output rotation shaft, is moved to a direction of the engine starting gear by the pushing mechanism, and rotates according to the rotation of the output rotation shaft, a pinion gear which is fit to the rotation member to be movable in the direction of the engine starting gear, moves with the rotation member if the pinion gear unit is moved towards the engagement location by the pushing mechanism, is engaged with the engine starting gear, and rotates with the rotation member according to the rotation of the output rotation shaft, and an elastic member which pushes the pinion gear to be biased to the direction of the engine starting gear, a first stopper unit which restricts the movement of the rotation member to the direction of the engine starting gear is provided on the output rotation shaft, a second stopper unit which restricts the movement of the pinion gears to the direction of the engine starting gear by pushing and biasing of the elastic member is provided on the rotation member, and the first stopper unit is positioned on a side opposite to the engine starting gear with respect to the second stopper unit.

In addition, there is provided an engine starting device according to the invention including:

a motor unit;

a pinion gear unit which rotates according to the rotation of an output rotation shaft driven by the motor unit; and a pushing mechanism which moves the pinion gear unit towards an engagement location of the pinion gears and an engine starting gear, in which an engine is started by a rotation force of the motor unit through the pinion gears, and the engine starting gear which are engaged with each other, the pinion gear unit includes a rotation member which spline-coupled to the output rotation shaft, is moved to a direction of the engine starting gear by the pushing mechanism, and rotates according to the rotation of the output rotation shaft, pinion gears which are fit to the rotation member to be movable in the direction of the engine starting gear, move with the rotation member if the pinion gear unit is moved towards the engagement location by the pushing mechanism, are engaged with the engine starting gear, and rotate with the rotation member according to the rotation of the output rotation shaft, an elastic member which pushes the pinion gears to be biased to the direction of the engine starting gear, a stopper unit which restricts the movement of the pinion gears to the direction of the engine starting gear by pushing and biasing of the elastic member, and a movement restriction unit which is provided over the outer periphery side of the rotation member and the inner periphery side of the pinion gears and restricts the movement of the pinion gears to the direction opposite to the direction of the engine starting gear.

Further, there is provided an engine starting device according to the invention including:

a motor unit;

a pinion gear unit which rotates according to the rotation of an output rotation shaft driven by the motor unit;

a pushing mechanism which moves the pinion gear unit towards an engagement location of the pinion gears and an engine starting gear; and a bracket which includes a bracket main body unit which supports the motor unit and the pushing mechanism and a nose unit which extends from the bracket main body unit to a side opposite to the motor and rotatably bears a tip portion of the output rotation shaft on a side opposite to the motor unit, and which is attached to an engine side, in which an engine is started by a rotation force of the motor unit through the pinion gears and the engine starting gear which are engaged with each other, the pinion gear unit includes a rotation member which spline-coupled to the output rotation shaft, is moved to a direction of the engine starting gear by the pushing mechanism, and rotates according to the rotation of the output rotation shaft, pinion gears which are fit to the rotation member to be movable in the direction of the engine starting gear, move with the rotation member if the pinion gear unit is moved towards the engagement location by the pushing mechanism, are engaged with the engine starting gear, and rotate with the rotation member according to the rotation of the output rotation shaft, and an elastic member which pushes the pinion gears to be biased to the direction of the engine starting gear, a first stopper unit which restricts the movement of the rotation member to the direction of the engine starting gear is provided on the output rotation shaft, a second stopper unit which restricts the movement of the pinion gears to the direction of the engine starting gear by pushing and biasing of the elastic member and a movement restriction unit which is provided over the outer periphery side of the rotation member and the inner periphery side of the pinion gears and restricts the movement of the pinion gears to the direction opposite to the direction of the engine starting gear are provided on the rotation member, and the first stopper unit is positioned on a side opposite to the engine starting gear with respect to the second stopper unit.

Advantageous Effects

According to the invention, since the first stopper unit which restricts the movement of the rotation member to the direction of the engine starting gear is provided on the output rotation shaft, the second stopper unit which restricts the movement of the pinion gears to the direction of the engine starting gear by pushing and biasing of the elastic member is provided on the rotation member, and the first stopper unit is positioned on a side opposite to the engine starting gear with respect to the second stopper unit, even in a case of a bracket which includes a bracket nose and bears a tip portion of the output rotation shaft in the tip portion of the bracket nose unit, it is not necessary to provide a stopper fixing groove on the tip portion of the output rotation shaft. Accordingly, it is possible to shorten the shaft length of the rotation member and to shorten the entire length of the engine starting device. Further, even if a great force is applied to the output shaft at the time of engine starting or the like, there is no concern that stress is concentrated on the portion of the stopper fixing groove, and the output shaft is curved or damaged in the worst case.

In addition, according to the invention, since the pinion gear unit includes a rotation member which spline-coupled to the output rotation shaft, is moved to a direction of the engine starting gear by the pushing mechanism, and rotates according to the rotation of the output rotation shaft, pinion gears which are fit to the rotation member to be movable in the direction of the engine starting gear, move with the rotation member if the pinion gear unit is moved towards the engagement location by the pushing mechanism, are engaged with the engine starting gear, and rotate with the rotation member according to the rotation of the output rotation shaft, an elastic member which pushes the pinion gears to be biased to the direction of the engine starting gear, a stopper unit which restricts the movement of the pinion gears to the direction of the engine starting gear by pushing and biasing of the elastic member, and a movement restriction unit which is provided over the outer periphery side of the rotation member and the inner periphery side of the pinion gears and restricts the movement of the pinion gears to the direction opposite to the direction of the engine starting gear, it is not necessary to perform a process of a third stopper unit (reference numeral 27 in FIG. 1 of Patent Citation 1 and reference numeral 42 in FIG. 1 of Patent Citation 2) which restricts axial direction movement of the pinion to the side opposite to the second stopper unit on the outer periphery of the rotation member in the engine starting device, and accordingly, it is possible to shorten the shaft length of the rotation member, to shorten the entire length of the engine starting device, and perform the process with low cost and improve productivity.

Further, since it is possible to shorten the entire length of the engine starting device, in the assembly of the engine starting device, it is possible to improve feasibility of a layout on the engine side.

BEST MODE FOR CARRYING OUT THE INVENTION

Embodiment 1

Figure 1:
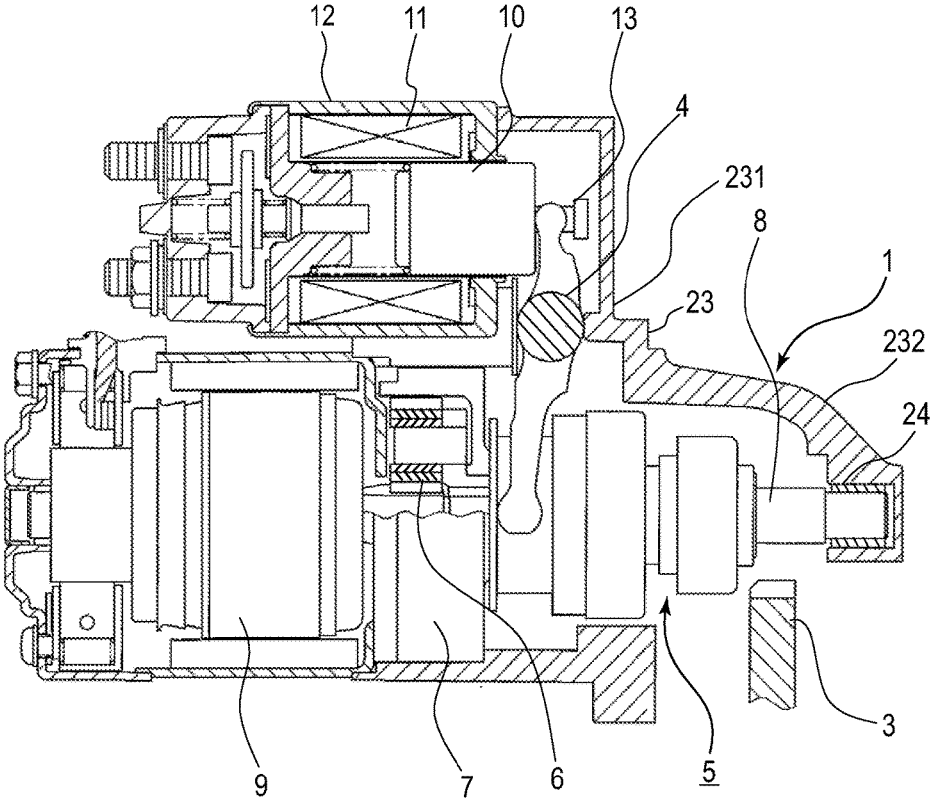
FIG. 1 is a view showing Embodiment 1of the invention and is a cross-sectional view showing an example of an engine starting device.
Figure 2:
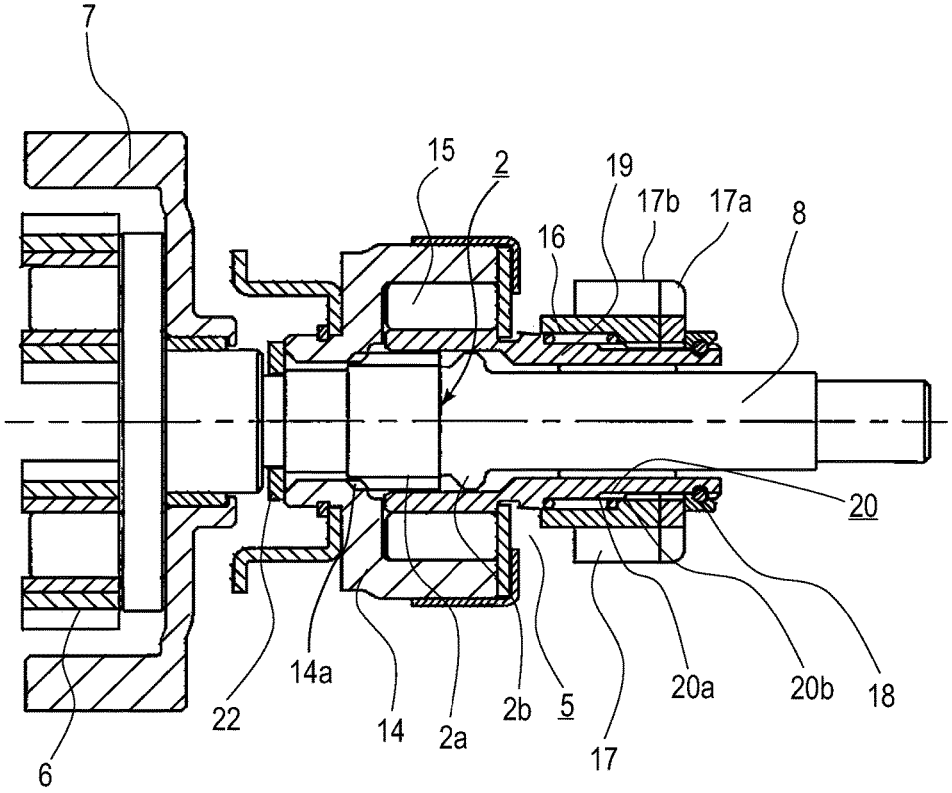
FIG. 2 is a view showing Embodiment 1 of the invention and is a cross-sectional view showing an example of a mechanism unit.

Hereinafter, Embodiment 1 of the invention will be described with reference to FIGS. 1 to 3. FIG. 1 is a cross-sectional view showing an example of an engine starting device, FIG. 2 is a cross-sectional view showing an example of a mechanism unit, and FIG. 3 shows a structure of an example of a first stopper unit and is a view for explaining assembly of a movement rotation member and for explaining a function of the first stopper unit.

In FIG. 1, an engine starting device 1 includes a motor which generates torque when current is supplied, an electromagnetic switch 12 which turns on and off supply of power to the motor 9, a movement rotation member 5 which magnetizes a plunger 10 by supplying current to a solenoidal coil 11 in the electromagnetic switch 12, turns on and off of the supply of power to the motor by the movement and at the same time, attaches the pushing mechanism 4 to a hook 13 attached to the plunger, is positioned on a side opposite to the electromagnetic switch 12 with respect to the pushing mechanism 4, and includes a one-direction clutch mechanism which shields torque from the pinion 17 and the ring gear side when engaged to an engine starting gear 3 such as a ring gear (hereinafter, referred to as a "ring gear"), a deceleration mechanism unit which is formed of a planet gear 6 and an internal gear 7 which are disposed on a rear side of the movement rotation member 5 and transfer deceleration torque, and an output rotation shaft 8 which includes helical spline-coupling unit which holds the planet gear and the internal gear. The helical spline-coupling unit transfers torque to the movement rotation member 5 and at the same time, also functions as a stopper which restricts axial direction movement of the movement rotation member 5 to the ring gear 3 side, that is, axial direction movement of a rotation member 19 to the ring gear 3 side. The movement rotation member 5 is configured of a thrust spline 14, a roller 15, and a pinion gear unit (configured with pinion gears 17, 17*a*, and 17*b*, a second stopper unit 18, a rotation member 19, and the like).

A tip of the output rotation shaft 8 is supported by a shaft bearing is provided on a tip portion of a front bracket on the engine side, and a helical spline unit 2 provided on the output rotation shaft 8 is configured of an engagement unit 2*a* which is engaged with the movement rotation member 5, and a first stopper unit 2*b* which is provided between the engagement unit 2*a* and a groove and restricts movement of the movement rotation member 5 in the axial direction. The engagement unit 2*a* is in a spline shape, and the first stopper unit 2*b* is in a spline shape by gear elements, phases of which are corresponded with the phase of the engagement unit 2*a*, in the same manner, however, the gear shape of the first stopper unit 2*b* is in a distant-tooth shape with respect to the gear of the engagement unit 2*a*, and the spline shape of the thrust spline 14 of the movement rotation member 5 which is engaged with the engagement unit 2*a* is a gear shape corresponding to the first stopper unit 2*b*.

Figure 3A:
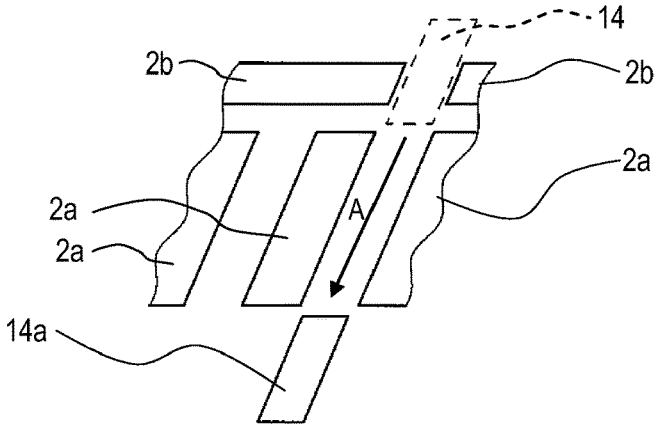
FIGS. 3A, 3B and 3C are views showing Embodiment 1 of the invention, showing a structure of an example of a first stopper unit, a view for explaining assembly of a movement rotation member and for explaining a function of the first stopper unit.
Figure 3B:
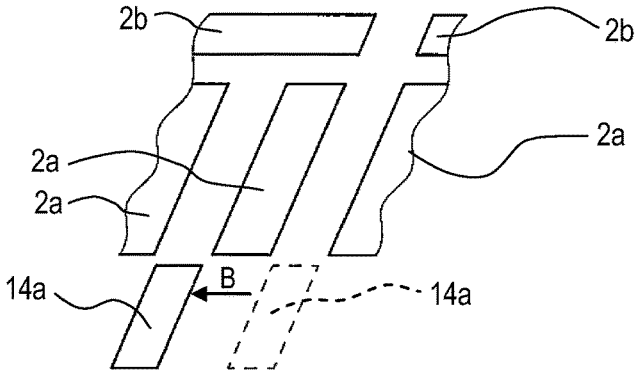
Figure 3C:
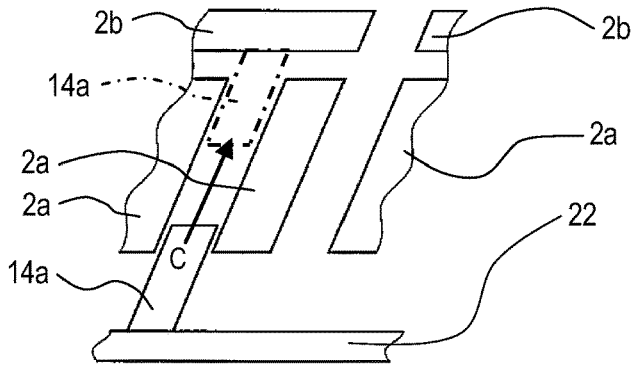

Next, a procedure of assembly of the thrust spline 14 and the helical spline unit 2 of the output shaft 8 is shown in FIG. 3.

A spline unit 14*a* of the thrust spline 14 is deeply inserted to the engagement unit 2*a* and the first stopper unit 2*b* of the helical spline unit 2 as shown with an arrow A. At that time, the spline unit 14*a* of the thrust spline 14 and the engagement unit 2*a* are designed so as not to be overlapped to each other with respect to the axial direction (see FIG. 3(*a*)).

Then, the spline unit 14*a* of the thrust spline 14 is rotated with respect to the gear elements of the engagement unit 2*a* in a circumferential direction for one tooth as shown with an arrow B (see FIG. 3(*b*)).

Next, the spline unit 14*a* of the thrust spline 14 is moved in a front direction, and a retaining ring 22 which restricts movement to a rear direction is attached. At that time, the position of the retaining ring 22 is designed so that the spline unit 14*a*of the thrust spline 14 and the engagement unit 2*a* are overlapped with each other with respect to the axial direction (see FIG. 3(*c*)).

By using such structures, it is possible to relatively easily perform the assembly.

In addition, in a state of FIG. 3(*c*) which is the assembly completed state, if the movement rotation member 5, which is the pinion gear unit, that is the rotation member 19 is moved towards the engagement location of the pinion gear 17 and the engine starting gear 3 by the pushing mechanism 4 in the axial direction, the spline unit 14*a* of the thrust spline 14 is moved to a location shown with a dashed-dotted line in a direction of an arrow C to abut the first stopper unit 2*b*, and the axial direction movement of the movement rotation member 5, which is the pinion gear unit, that is, the rotation member 19 towards the engagement location is restricted by the first stopper unit 2*b*.

By providing the first stopper unit 2*b* on the inner side of the movement rotation member 5, that is the inner side of the rotation member 19, since the bracket of the related art includes a bracket nose unit, and it is possible to remove the first stopper unit on the tip of the output rotation shaft 8 in a case of a type of bearing the tip portion of the output shaft by the tip portion of the bracket nose unit, it is possible to suppress the increasing of the shaft length from the tip of the pinion 17 to the tip of the engine starting device 1, and at the same time, it is also possible to expect an effect of sound reduction, since collision sound of the spline unit 14*a* and the first stopper unit 2*b* of the movement rotation member 5 is generated in the engine starting device 1.

Embodiment 2

Figure 4:
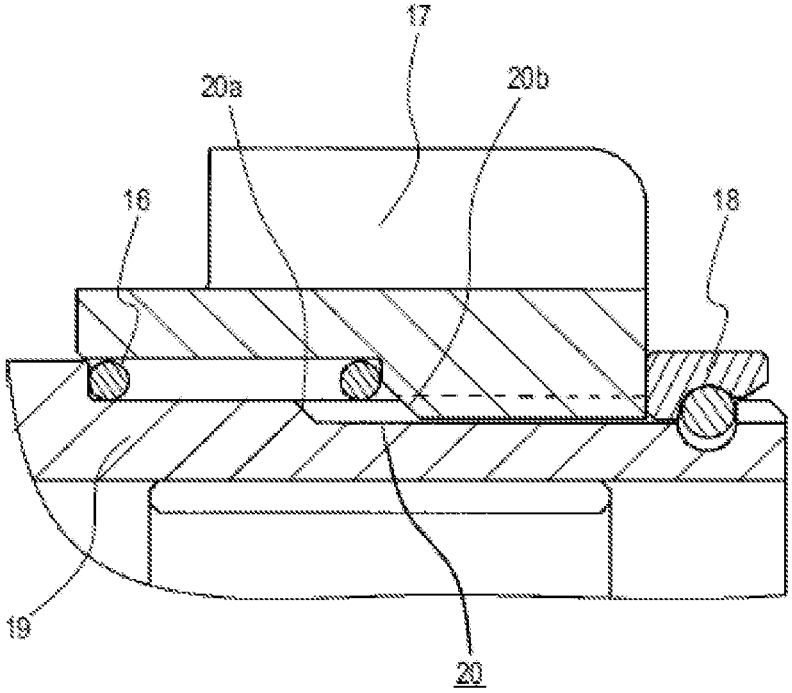
FIG. 4 is a view showing Embodiment 2 of the invention and is a cross-sectional view showing an example of a movement restriction unit.

Hereinafter, Embodiment 2 of the invention will be described with reference to FIG. 4. FIG. 4 is a cross-sectional view showing an example of a movement restriction unit.

In FIG. 4, the movement rotation member 5 is configured with the thrust spline 14 including a function of a clutch outer including a helical spline to be engaged with the output rotation shaft 8, the cylindrical rotation member 19 including a function of a clutch inner, the wedge-shaped roller 15 configured between the thrust spline 14 and the rotation member 19, and a spring (not shown), and has a function as a one-direction clutch.

The outer periphery portion of the rotation member 19 on the front side is formed in a serration shape, and by engaging the rotation member with the pinion 17 formed in a serration shape on the inner radius side in the same manner, the torque from the rotation member 19 is transferred to the pinion 17.

In addition, an elastic member 16 such as a spring is interposed between the rotation member 19 and the pinion 17, and the second stopper unit 18 which restricts the movement of the pinion 17 in the axial direction is configured on the tip of the rotation member 19.

Figure 6:
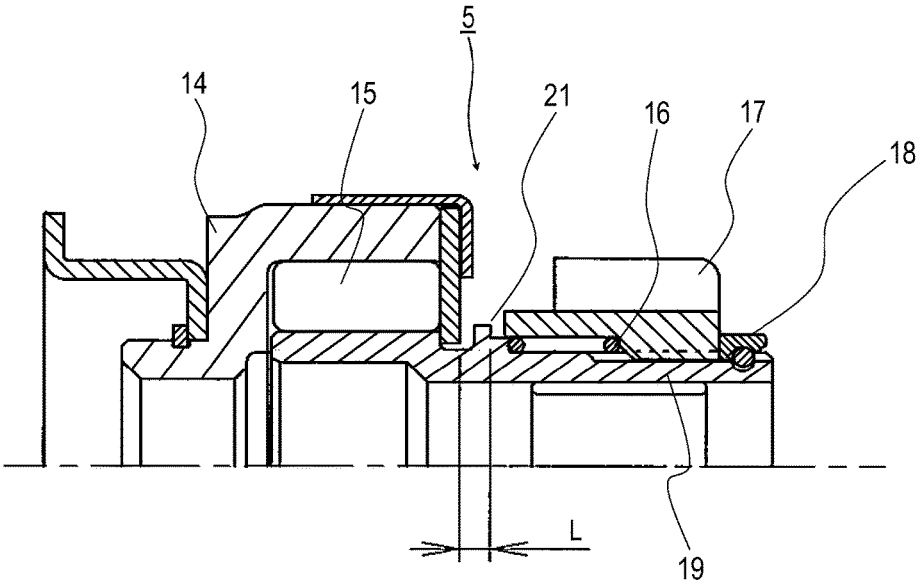
FIG. 6 is a cross-sectional view showing a movement rotation member of the related art.

Herein, as shown in FIG. 6, in the movement rotation member 5 of the related art, when the movement rotation member is engaged in a direction of the ring gear of the engine by the pushing mechanism 4, in a case where the ring gear 3 and the pinion 17 are not engaged with each other and the end surfaces thereof come in contact with each other, the movement rotation member 5 is moved to the relatively front side with respect to the pinion 17 by pressing the elastic member 16, however, a movement restriction unit 21 of the related art of the pinion 17 is provided on the rotation member 19 or the like so as not to make a length of the elastic member 16 to be a length with full pressure.

On the contrary, in Embodiment 2, a rotation member side movement restriction abutting surface 20*a* which formed an upper-chamfered portion at an angle of 45° on the rear end portion of a serration unit configured on the outer periphery of the rotation member 19 and a pinion side movement restriction abutting surface 20*b* which has a chamfered surface at an angle of 45° on the rear end portion of the serration unit on the inner diameter of the pinion 17 in the same manner are provided, to configure a movement restriction unit 20, and by abutting the rotation member side movement restriction abutting surface 20*a* of the movement restriction unit 20 and the pinion side movement restriction abutting surface 20*b* thereof, it is possible to restrict the movement of the pinion.

Accordingly, it is possible to shorten the entire length to a portion just before contacting the component which is behind the pinion 17 (L portion in FIG. 6) , it is possible to shorten the entire length of the engine starting device, and at the same time, the shape of the serration unit of Embodiment 1 can correspond to small change with respect to the serration of the related art. In addition, by removing the movement restriction unit 21 of the related art of the rotation member 19 or the like, which restricts the movement of the pinion 17 to the rear direction, the processing cost is suppressed and productivity is improved. Further, with the assembly with First Example, it is possible to further suppress the increasing of the shaft length.

Embodiment 3

Figure 5:
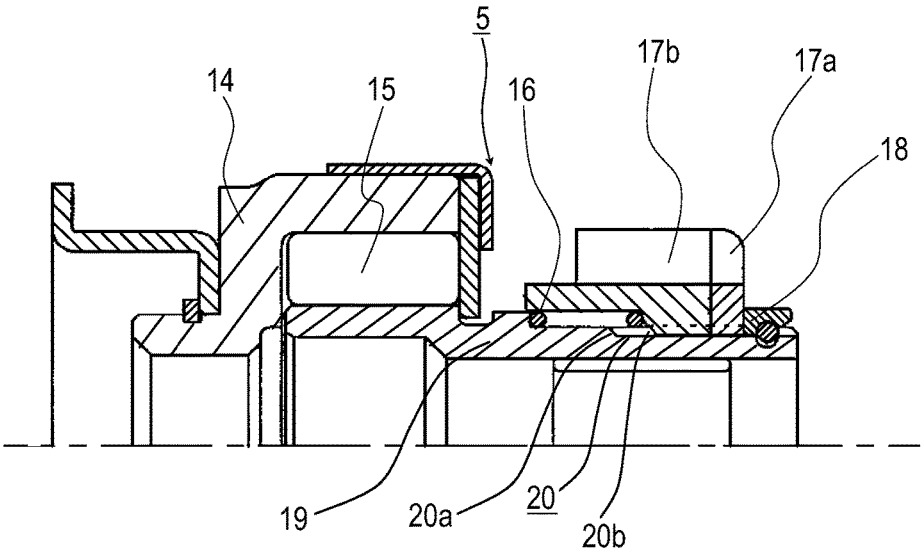
FIG. 5 is a view showing Embodiment 3 of the invention and is a cross-sectional view showing an example of a rotation member.

Hereinafter, Embodiment 3 of the invention will be described with reference to FIG. 5. FIG. 5 is a cross-sectional view showing an example of the rotation member.

The pinion unit is in a protruded tooth shape for synchronization, and is configured with the first pinion 17*a* which initially collides with the ring gear 3 at the time of starting engagement with the ring gear 3, and the second pinion 17*b* which plays a role of transferring the rotation force after the engagement. Accordingly, in a specification of an eco-running system such as a idling stop system such as a case of engaging the pinion 17 in the rotation of the ring gear 3, it is possible to obtain an engine starting device in which further precise synchronization and phase focusing are performed at the time of abutting and the noise, shortening of life due to abrasion, and delay of starting performance due to loss of engagement time do not occur.

As described above, as long as the dimensional data of the serration unit of the pinion, the entire length of the pinion, and the dimensional relationship of the elastic member such as a spring to be fit in the circumferential direction do not change, even if the shape of the pinion is changed, since it is possible to attach the first and second pinions 17*a* and 17*b* to the rotation member 19, it is possible to apply the invention of Embodiment 2.

In addition, the same reference numerals in each drawing of FIGS. 1 to 6 denote the same or corresponding portions.

In addition, as clear in the above description and each drawing described above, the following technical features are provided in FIGS. 1 to 5 and Embodiments 1 to 3.

Feature 1: In an engine starting device comprising: a motor unit 9; a pinion gear unit (configured with 17, 17*a*, 17*b*, 18, 19, and the like) which rotates according to the rotation of an output rotation shaft 8 driven by the motor unit 9; a pushing mechanism 4 which moves the pinion gear unit (configured with 17, 17*a*, 17*b*, 18, 19, and the like) towards an engagement location of the pinion gear 17 and an engine starting gear 3; and a bracket 23 which includes a bracket main body unit 231 which supports the motor unit 9 and the pushing mechanism 4 and a nose unit 232 which extends from the bracket main body unit 231 to a side opposite to the motor unit 9 and rotatably bears a tip portion of the output rotation shaft 8 on a side opposite to the motor unit 9, and which is attached to an engine side, an engine is started by a rotation force of the motor unit 9 through the pinion gear 17 and the engine starting gear 3 which are engaged with each other, the pinion gear unit (configured with 17, 17*a*, 17*b*, 18, 19, and the like) includes a rotation member 19 which spline-coupled to the output rotation shaft 8, is moved to a direction of the engine starting gear 3 by the pushing mechanism 4, and rotates according to the rotation of the output rotation shaft 8, a pinion gear 17 which is fit to the rotation member 19 to be movable in the direction of the engine starting gear 3, moves with the rotation member 19 if the pinion gear unit (configured with 17, 17*a*, 17*b*, 18, 19, and the like) is moved towards the engagement location by the pushing mechanism 4, is engaged with the engine starting gear 3, and rotates with the rotation member 19 according to the rotation of the output rotation shaft 8, and an elastic member 16 which pushes the pinion gear 17 to be biased to the direction of the engine starting gear 3, a first stopper unit 2*b* which restricts the movement of the rotation member 19 to the direction of the engine starting gear 3 is provided on the output rotation shaft 8, a second stopper unit 18 which restricts the movement of the pinion gears 17*a* and 17*b* to the direction of the engine starting gear 3 by pushing and biasing of the elastic member 16 is provided on the rotation member 19, and the first stopper unit 2*b* is positioned on a side opposite to the engine starting gear 3 with respect to the second stopper unit 18.

2: In the engine starting device according to Feature 1, the first stopper unit 2*b* is formed on a spline unit on the output rotation shaft 8 side, and the movement of the rotation member 19 to the direction of the engine starting gear 3 is restricted by abutting the spline unit on the rotation member 19 side to the first stopper unit 2*b*.

Feature 3: In an engine starting device including: a motor unit 9, a pinion gear unit (configured with 17, 17*a*, 17*b*, 18, 19, and the like) which rotates according to the rotation of an output rotation shaft 8 driven by the motor unit 9; and a pushing mechanism 4 which moves the pinion gear unit (configured with 17, 17*a*, 17*b*, 18, 19, and the like) towards an engagement location of the pinion gears 17*a* and 17*b*, and an engine starting gear 3, an engine is started by a rotation force of the motor unit 9 through the pinion gears 17*a* and 17*b*, and the engine starting gear 3 which are engaged with each other, the pinion gear unit (configured with 17, 17*a*, 17*b*, 18, 19, and the like) includes a rotation member 19 which spline-coupled to the output rotation shaft 8, is moved to a direction of the engine starting gear 3 by the pushing mechanism 4, and rotates according to the rotation of the output rotation shaft 8, pinion gears 17*a* and 17*b* which are fit to the rotation member 19 to be movable in the direction of the engine starting gear 3, move with the rotation member 19 if the pinion gear unit (configured with 17, 17*a*, 17*b*, 18, 19, and the like) is moved towards the engagement location by the pushing mechanism 4, are engaged with the engine starting gear 3, and rotate with the rotation member 19 according to the rotation of the output rotation shaft 8, an elastic member 16 which pushes the pinion gears 17*a* and 17*b* to be biased to the direction of the engine starting gear 3, a stopper unit which restricts the movement of the pinion gears 17*a* and 17*b* to the direction of the engine starting gear 3 by pushing and biasing of the elastic member 16, and a movement restriction unit 20 which is provided over the outer periphery side of the rotation member 19 and the inner periphery side of the pinion gears 17*a* and 17*b* and restricts the movement of the pinion gears 17*a* and 17*b* to the direction opposite to the direction of the engine starting gear 3.

Feature 4: In the engine starting device according to Feature 3, a rotation member side movement restriction abutting surface 20*a* is formed on the outer periphery side of the rotation member 19, a pinion side movement restriction abutting surface 20*b* is formed on the inner periphery side of the pinion gears 17*a* and 17*b*, if the pinion gears 17*a* and 17*b* abut the engine starting gear 3 and the pinion gears 17*a* and 17*b* are moved to the direction opposite to the direction of the engine starting gear 3 against a pushing and biasing force of the elastic member 16 by moving the pinion gear unit (configured with 17, 17*a*, 17*b*, 18, 19, and the like) to the engagement location by the pushing mechanism 4, the pinion side movement restriction abutting surface 20*b* on the inner periphery side of the pinion gears 17*a* and 17*b* abut the rotation member side movement restriction abutting surface 20*a* on the outer periphery side of the rotation member 19, and the movement amount of the pinion gears 17*a* and 17*b* to the direction opposite to the direction of the engine starting gear 3 is restricted to a predetermined movement amount.

Feature 5: In the engine starting device according to Feature 3 or 4, the stopper unit is positioned on the pinion gears 17*a* and 17*b* on the side of the engine starting gear 3, and the movement restriction unit 20 is positioned on the pinion gears 17*a* and 17*b* on the side opposite to the side of the engine starting gear 3.

Feature 6: In the engine starting device according to any one of Features 3 to 5, the pinion gears 17*a* and 17*b* are configured with a first pinion gear unit 17*a* on the side of the engine starting gear 3, and a second pinion gear unit 17*b* which is adjacent to the first pinion gear unit 17*a* and is on a side opposite to the side of the engine starting gear 3, and by moving the pinion gear unit (configured with 17, 17*a*, 17*b*, 18, 19, and the like) to the engagement location by the pushing mechanism 4, the first pinion gear unit 17*a* are initially engaged with the engine starting gear 3, and the second pinion gear unit 17*b* is subsequently engaged with the engine starting gear 3.

Feature 7: In the engine starting device according to Feature 6, a thickness of the first pinion gear 17*a* in the direction of the engine starting gear 3 is smaller than a thickness of the second pinion gear 17*b* in the direction of the engine starting gear 3.

Feature 8: In the engine starting device according to Feature 6 or 7, the first pinion gear 17*a* has a function of performing rotation synchronization with the engine starting gear 3, and the second pinion gear 17*b* has a function of transferring a rotation force of the second pinion gear 17*b* to the engine starting gear 3 by the engagement with the engine starting gear 3.

Feature 9: In an engine starting device including: a motor unit 9, a pinion gear unit (configured with 17, 17*a*, 17*b*, 18, 19, and the like) which rotates according to the rotation of an output rotation shaft 8 driven by the motor unit 9; a pushing mechanism 4 which moves the pinion gear unit (configured with 17, 17*a*, 17*b* , 18, 19, and the like) towards an engagement location of the pinion gears 17*a* and 17*b*, and an engine starting gear 3; and a bracket 23 which includes a bracket main body unit 231 which supports the motor unit 9 and the pushing mechanism 4 and a nose unit 232 which extends from the bracket main body unit 231 to a side opposite to the motor 9 and rotatably bears a tip portion of the output rotation shaft 8 on a side opposite to the motor unit 9, and which is attached to an engine side, an engine is started by a rotation force of the motor unit 9 through the pinion gears 17*a* and 17*b* and the engine starting gear 3 which are engaged with each other, the pinion gear unit (configured with 17, 17*a*, 17*b*, 18, 19, and the like) includes a rotation member 19, which is spline-coupled to the output rotation shaft 8, is moved to a direction of the engine starting gear 3 by the pushing mechanism 4, and rotates according to the rotation of the output rotation shaft 8, pinion gears 17*a* and 17*b* which are fit to the rotation member 19 to be movable in the direction of the engine starting gear 3, move with the rotation member 19 if the pinion gear unit (configured with 17, 17*a*, 17*b*, 18, 19, and the like) is moved towards the engagement location by the pushing mechanism 4, are engaged with the engine starting gear 3, and rotate with the rotation member 19 according to the rotation of the output rotation shaft 8, and an elastic member 16 which pushes the pinion gears 17*a* and 17*b* to be biased to the direction of the engine starting gear 3, a first stopper unit 2*b* which restricts the movement of the rotation member 19 to the direction of the engine starting gear 3 is provided on the output rotation shaft 8, a second stopper unit 18 which restricts the movement of the pinion gears 17*a* and 17*b* to the direction of the engine starting gear 3 by pushing and biasing of the elastic member 16 and a movement restriction unit 20 which is provided over the outer periphery side of the rotation member 19 and the inner periphery side of the pinion gears 17*a* and 17*b* and restricts the movement of the pinion gears 17*a* and 17*b* to the direction opposite to the direction of the engine starting gear 3 are provided on the rotation member 19, and the first stopper unit 2*b* is positioned on a side opposite to the engine starting gear 3 with respect to the second stopper unit 18.

Feature 10: In the engine starting device according to Feature 9, a rotation member side movement restriction abutting surface 20*a* is formed on the outer periphery side of the rotation member 19, a pinion side movement restriction abutting surface 20*b* is formed on the inner periphery side of the pinion gears 17*a* and 17*b*, if the pinion gears 17*a* and 17*b* abut the engine starting gear 3 and the pinion gears 17*a* and 17*b* are moved to the direction opposite to the direction of the engine starting gear 3 against a pushing and biasing force of the elastic member 16, by moving the pinion gear unit (configured with 17, 17*a*, 17*b*, 18, 19, and the like) to the engagement location by the pushing mechanism 4, the pinion side movement restriction abutting surface 20*b* on the inner periphery side of the pinion gears 17*a* and 17*b* abut the rotation member side movement restriction abutting surface 20*a* on the outer periphery side of the rotation member 19, and the movement amount of the pinion gears 17*a* and 17*b* to the direction opposite to the direction of the engine starting gear 3 is restricted to a predetermined movement amount.

Feature 11: In the engine starting device according to Feature 9 or 10, the stopper unit is positioned on the pinion gears 17*a* and 17*b* on the side of the engine starting gear 3, and the movement restriction unit 20 is positioned on the pinion gears 17*a* and 17*b* on the side opposite to the side of the engine starting gear 3.

Feature 12: In the engine starting device according to any one of Features 9 to 11, the pinion gears 17*a* and 17*b* are configured with a first pinion gear unit 17*a* on the side of the engine starting gear 3, and a second pinion gear unit 17*b* which is adjacent to the first pinion gear unit 17*a* and is on a side opposite to the side of the engine starting gear 3, and by moving the pinion gear unit (configured with 17, 17*a*, 17*b*, 18, 19, and the like) to the engagement location by the pushing mechanism 4, the first pinion gear unit 17*a* are initially engaged with the engine starting gear 3, and the second pinion gear unit 17*b* is subsequently engaged with the engine starting gear 3.

Feature 13: In the engine starting device according to Feature 12, a thickness of the first pinion gear 17*a* in the direction of the engine starting gear 3 is smaller than a thickness of the second pinion gear 17*b* in the direction of the engine starting gear 3.

Feature 14: In the engine starting device according to Feature 12 or 13, the first pinion gear 17*a* has a function of performing rotation synchronization with the engine starting gear 3, and the second pinion gear 17*b* has a function of transferring a rotation force of the second pinion gear 17*b* to the engine starting gear 3 by the engagement with the engine starting gear 3.

Feature 15: In an engine starting device including: a starter motor 9; a movement rotation member 5 which is spline-coupled to an output shaft 8 side of the starter motor 9 and slides in an axial direction; pinion gear units 17*a* and 17*b* which are attached not to be relatively rotated to an cylindrical member 19 configuring a part of the movement rotation member 5; a pushing mechanism 4 which moves the pinion gear units 17*a* and 17*b* to the engagement location of a ring gear 3; and a ring gear 3 which is engaged with the pinion units 17*a* and 17*b* pushed by the pushing mechanism 4 and starts an engine by transferring a rotation force of the starter motor 9, a first stopper unit 2*b* which restricts the movement of the movement rotation member 5 is configured on the output shaft 8, a second stopper unit 18 which restricts the movement of the pinion unit in the axial direction is configured on the cylindrical member 19, and the first stopper unit 2*b* is disposed on a side opposite to the ring gear gear 3 with respect to the second stopper unit 18.

Feature 16: In the engine starting device according to Feature 15, the first stopper unit 2*b*is disposed on the inner periphery of the cylindrical member.

Feature 17: In the engine starting device according to Feature 15 or 16, the first stopper unit 2*b* is formed on a spline unit on the output shaft, and the movement of the movement rotation member 5 to the ring gear gear 3 side in the axial direction is restricted by abutting a spline unit 14*a* formed on the inner periphery of the movement rotation member 5 to the first stopper unit 2*b*.

Feature 18: In the engine starting device according to any one of Features 15 to 17, the stopper unit which restricts the movement of the pinion units 17*a* and 17*b* in the axial direction is configured on the cylindrical member 19 on the ring gear gear 3 side, an elastic member 16 such as a spring is provided on a side opposite to the stopper interposing the pinion units 17*a* and 17*b*, the first pinion 17*a* and the second pinion 17*b* are biased to the stopper side by being pushed by the elastic member 16, and a pinion movement restriction unit 20 is provided on a cylindrical member so as to restrict the movement of the pinion units 17*a*and 17*b* before the length of the elastic member 16 becomes a length with full pressure, when a force is applied to the end surface of the pinion unit and the pinion units 17*a* and 17*b* are moved to the opposite to the ring gear gear 3 side while pressing the elastic member 16.

Feature 19: In the engine starting device according to Feature 18, the pinion movement restriction unit 20 is formed on the end portion of the serration unit formed on the outer periphery of the cylindrical member 19.

Feature 20: In the engine starting device according to Feature 19, the pinion movement restriction unit 20 forms an upper-chamfered portion 20*a* at an angle of 45° on the end portion of the serration unit configured on the outer periphery of the rotation member 19 and forms a chamfered portion 20*b* at an angle of 45° on the end portion of the pinion 17 in the same manner, and performs movement restriction by abutting of the upper-chamfered portion 20*a* to the chamfered portion 20*b*.

Feature 21: In the engine starting device according to any one of Features 15 to 20, the pinion units 17*a* and 17*b* are in a protruded tooth shape for synchronization, and are configured with the first pinion gear 17*a* which initially collides with the ring gear gear 3 at the time of starting engagement with the ring gear gear 3, and the second pinion gear 17*b* which plays a role of transferring the rotation force after the engagement.

Feature 22: The engine starting device which can suppress the increasing of the shaft length due to the including of the elastic member 16 such as a spring on the movement rotation member 5, and at the same time, can suppress the increasing of the entire length of the engine starting device.

Feature 23: By disposing a stopper structure which restricts the movement of the movement rotation member 5 in the axial direction on the inner side of the movement rotation member 5, the increasing of the shaft length from the tip of the pinion 17 to the tip of the engine starting device is suppressed.

In addition, the elastic member 16 such as a spring included in the movement rotation member 5 is attached to the outer periphery of the cylindrical member which transfers the rotation force to the pinion 17, and when the pinion 17 of the movement rotation member 5 is engaged in a direction of the ring gear gear 3 of the engine by the pushing mechanism 4 of the engine starting device, in a case where both of them are not engaged with each other and the end surfaces thereof come in contact with each other, the movement rotation member 5 is moved to the relatively front side with respect to the pinion, by pressing the elastic member 16. A configuration in which a stopper unit (reference numeral 21 in FIG. 6) which restricts the movement of the pinion 17 in the axial direction for avoiding a state with full pressure of the elastic member 16 is configured on the cylindrical member 19 is removed, and the increasing of the shaft length is suppressed by applying a function as the stopper 10*a* to the serration which configures a part of the movement rotation member and is configured on the outer periphery of the cylindrical member 19 which transfers the rotation force to the pinion 17.

Feature 24: The increasing of the shaft length of the movement rotation member 5 of the engine starting device can be suppressed, and in the assembly of the engine starting device, not only feasibility of a layout on the engine side can be improved, but also an effect of sound reduction can be expected by generating collision of the movement rotation member 5 and the stopper 2*b* by the engagement thereof in the engine starting device at the time of operating the engine starting device, and since it is not necessary to perform a process of a stopper shape (reference numeral 21 in FIG. 6) on the cylindrical member 19 of the movement rotation member 5 in the engine starting device, it is possible to perform the process with low cost and improve productivity.

The invention claimed is:

1. An engine starting device comprising:

a motor unit;

a pinion gear unit which rotates according to the rotation around a rotational axis of an output rotation shaft driven by the motor unit; and a pushing mechanism which moves the pinion gear unit along the rotational axis toward an engagement location of a pinion gear and an engine starting gear, wherein an engine is started by a rotational force of the motor unit through the pinion gear, and the engine starting gear which are engaged with each other, the pinion gear unit includes:

a rotation member, which is spline-coupled to the output rotation shaft, is moved along the rotational axis toward the engine starting gear by the pushing mechanism, and rotates according to the rotation of the output rotation shaft:

the pinion gear, which is fit to the rotation member to be movable along the rotational axis toward the engine starting gear, moves with the rotation member if the pinion gear unit is moved along the rotational axis toward the engagement location by the pushing mechanism, is engaged with the engine starting gear, and rotates with the rotation member according to the rotation of the output rotation shaft;

an elastic member which pushes the pinion gear to be biased along the rotational axis toward the engine starting gear;

a stopper unit, which restricts the movement of the pinion gear that is along the rotational axis toward the engine starting gear due to pushing and biasing of the elastic member, is provided on the rotation member; and a movement restriction unit which is provided over the outer periphery side of the rotation member and the inner periphery side of the pinion gear and restricts the movement of the pinion gear along the rotational axis away from the engine starting gear, wherein a rotation member side movement restriction abutting surface is formed on the outer periphery side of the rotation member, a pinion side movement restriction abutting surface is formed on the inner periphery side of the pinion gear, and if the pinion gear abuts the engine starting gear such that the pinion gear is moved along the rotational axis away from the engine starting gear against a pushing and biasing force of the elastic member, in response to the pinion gear unit being moved along the rotational axis to the engagement location by the pushing mechanism, the pinion side movement restriction abutting surface on the inner periphery side of the pinion gear abuts the rotation member side movement restriction abutting surface on the outer periphery side of the rotation member, and the movement amount of the pinion gear along the rotational axis away from the engine starting gear is restricted to a predetermined movement amount.

2. The engine starting device according to claim 1, wherein the stopper unit is positioned at a location that is between the pinion gear and the engagement location along the rotational axis, and the movement restriction unit is positioned at a location that is away from the engine starting gear with respect to the location of the stopper unit along the rotational axis.

3. The engine starting device according to claim 1, wherein the pinion gear is configured with a first pinion gear and a second pinion gear which is adjacent to the first pinion along the rotational axis, the first pinion gear being positioned closer to the engine starting gear than the second pinion gear along the rotational axis, and by moving the pinion gear unit along the rotational axis to the engagement location by the pushing mechanism, the first pinion gear is initially engaged with the engine starting gear, and the second pinion gear is subsequently engaged with the engine starting gear.

4. The engine starting device according to claim 3, wherein a thickness of the first pinion gear along the rotational axis is smaller than a thickness of the second pinion gear along the rotational axis.

5. The engine starting device according to claim 3, wherein the first pinion gear has a function of performing rotation synchronization with the engine starting gear, and the second pinion gear has a function of transferring a rotational force of the second pinion gear to the engine starting gear by the engagement with the engine starting gear.

* * * * *